US007073691B2

(12) United States Patent
Rumrill et al.

(10) Patent No.: US 7,073,691 B2
(45) Date of Patent: Jul. 11, 2006

(54) CAULKING GUN

(75) Inventors: Danny Rumrill, 4870 Carriage La., Santa Rosa, CA (US) 95403; Larry C. Childs, Cotati, CA (US)

(73) Assignee: Danny Rumrill, Santa Rosa, CA (US)

( * ) Notice: Subject to any disclaimer, the term of this patent is extended or adjusted under 35 U.S.C. 154(b) by 44 days.

(21) Appl. No.: 10/874,628

(22) Filed: Jun. 23, 2004

(65) Prior Publication Data

US 2005/0023301 A1 Feb. 3, 2005

Related U.S. Application Data

(60) Provisional application No. 60/491,353, filed on Jul. 31, 2003.

(51) Int. Cl.
*B67D 5/42* (2006.01)

(52) U.S. Cl. ..... 222/391; 222/81; 222/327

(58) Field of Classification Search ..... 222/80–83, 222/326, 327, 391
See application file for complete search history.

(56) References Cited

U.S. PATENT DOCUMENTS 3,997,085 A * 12/1976 Lindquist ..... 222/326
4,009,804 A * 3/1977 Costa et al. ..... 222/391
4,135,644 A * 1/1979 Pacetti ..... 222/81
4,339,058 A * 7/1982 Wendt ..... 222/309
4,390,115 A * 6/1983 Bigham ..... 222/326
4,741,462 A * 5/1988 Schneider, Jr. ..... 222/386
5,638,997 A * 6/1997 Hawkins et al. ..... 222/391
6,349,857 B1 * 2/2002 Lepsius et al. ..... 222/391
6,446,309 B1 * 9/2002 DeWeese ..... 16/430
6,672,489 B1 * 1/2004 Huang ..... 222/391

FOREIGN PATENT DOCUMENTS

JP 09150091 A * 6/1997

* cited by examiner

*Primary Examiner*—Michael Mar
*Assistant Examiner*—Melvin A Cartagena
(74) *Attorney, Agent, or Firm*—William B. Ritchie

(57) ABSTRACT

A caulking gun for dispensing caulking material from a standard caulk tube. The gun is fabricated in three basic parts; a trigger assembly, a trigger housing and a barrel cage for holding the tube. The facing portions of the barrel cage and trigger housing is provided with a mating configuration which enables the gun to be easily assembled for use and easily disassembled for storage in a toolbox. A novel drip/no drip feature is provided wherein a cam actuator conveniently positioned on the trigger housing enables an operator to select between no drip operation or drip type operation when caulking material and application requirements warrant such. A thumb release mechanism is provided on the rear of the trigger housing so the operator can release the driving rod for insertion of another tube of caulk when the unit has been placed in the drip position.

15 Claims, 10 Drawing Sheets

CAULKING GUN

This application claims the benefit of U.S. Provisional Application No. 60/491,353, filed Jul. 31, 2003.

BACKGROUND OF THE INVENTION

1. Field of the Invention

The invention relates to hand-held material-dispensing devices such as caulking guns and, more particularly, to a specific type of construction for caulking guns.

2. Description of the Related Art

Hand-held material dispensing devices are well known in the art and generally rely on the action of a piston to push fluid out of a receptacle toward the application area. The movement of the piston is induced by the advancement of a piston rod in the direction of the receptacle, with the piston rod being advanced in the direction of travel by the operator's squeezing of a trigger in engagement therewith.

One such fluid dispenser is disclosed in U.S. Pat. No. 4,461,407 to Finnegan. The Finnegan patent incorporates an automatic pressure release mechanism such as is typical in many caulking guns of the prior art.

In U.S. Pat. No. 4,081,112, issued to Chang, there is disclosed a caulking gun having a forward-biasing spring to urge the trigger back to the cocked position after an application cycle. U.S. Pat. No. 4,033,484, issued to Ornsteen, discloses a hot melt adhesive gun which operates in the conventional manner of the prior art.

U.S. Pat. No. 3,069,053, issued to Nilsson and U.S. Pat. No. 3,189,226, issued to Sherbondy, each show a caulking gun with an alternative piston rod-trigger engagement arrangement. In these references, the trigger urges the piston rod toward the fluid receptacle by means by a ratchet mechanism.

The above-cited patents are merely examples of the plethora of caulking guns in the prior art. As is clear from these examples, that a standard caulking gun provides an arrangement for receiving and retaining a tube of caulking material. The caulk tube has a pointed nozzle at the forward end for dispensing the caulking material as it is pushed from the other end by a driven back plate. A long pusher rod in the body of the caulking gun serves to drive the caulk tube back plate to extrude the caulking material. A trigger mechanism at the back end of the caulking gun serves to advance the pusher rod when activated by a user. A pusher plate is mounted on the forward end of the pusher rod to distribute the forces from the rod to the back plate at the end of the caulking tube.

U.S. Pat. No. 5,887,765, issued to Broesamle, discloses a caulking gun that enables the pressure on the back plate to be eased when an operator is no longer engaging the trigger. Thus, a non-dripping capability is achieved using a mechanism that permits the pusher rod to slide backwards slightly thus stopping further extrusion of the caulking material. However, some types of caulking material for proper application require a continued pressure against the back plate even when the trigger is not being pulled, i.e., the ratchet type of mechanism.

Model CG-00122 caulking gun, manufactured by Great American Manufacturing, Inc. of Sun Valley, Calif. 91352, features a ratchet-type caulking gun wherein a user can select either dripless or no-drip operation The selector switch changes the angle by which a spring biased plate engages one of the plurality of notches that are provided along the piston rod. This achieves the alternative methods of operation. The barrel cage does not rotate but is riveted to the hand grip housing.

Model SI 300, manufactured by Dripless, Inc. of Santa Rosa, Calif. 95403, is no drip, drip selectable caulking gun. In this model, a dog is provided on the rear of the hand grip housing. This dog is biased by a compression spring that also is exposed on the rear of the hand grip housing so that the mechanism is potentially vulnerable to damage due to being struck or by due to dirt accumulation.

There is not found in the prior art, a caulking gun that can function as either a dripless unit as taught by Broesamle or a drip-type of device as discussed above by merely activating a lever switch on the handle of the caulking gun that selects either a dripless or a standard method of operation and features a rotatable barrel that can be easily removed so that the caulking gun can be more conveniently packed within a tool box.

SUMMARY OF THE INVENTION

Particular arrangements in accordance with the present invention comprise a caulking gun for the dispensing of caulking material commonly used in construction work and the repair and remodeling of residential and other types of buildings. The caulking material is conventionally provided in cylinders or tubes having a hollow tip from which the caulking material is extruded by the action of a piston or back plate which is advanced from the rear of the tube toward the tip. Because of the length and weight of the caulk tube, it is not uncommon to provide a support member (a "barrel") extending forward of the handle underneath the caulk tube. Caulking guns are designed to hold such a caulk tube in a receiver housing, often barrel-shaped in the form of a half cylinder, within which there is installed a longitudinally movable rod with a piston member at the forward end of the rod for pushing the caulking material out of the caulk tube.

The caulking gun further includes a pistol grip handle secured to the handle housing, a trigger pivotably mounted to the housing so as to cooperate with the handle and a drive mechanism for coupling the trigger to the rod to drive it forward when the trigger is squeezed. There is also a mechanism for uncoupling the trigger from the rod when the trigger is released. Through repeated operation of the trigger, the rod and piston member may be advanced in the direction of the caulk tube tip, thereby providing the means for dispensing the contents of the caulk tube through the forward nozzle.

A precision cutter for cutting the tip of a caulk tube is also provided that is activated when the trigger is squeezed. The cutter is accessed by inserting the tip through an opening in the handle to the desired length and angle and then squeezing the trigger so that the tip is cleanly and easily cut with a blade that is inside the handle and attached to the trigger.

The caulking gun handle also includes a lever operated cam switch that enables the apparatus to function so that the rod is not uncoupled from the trigger when the trigger is released.

Caulking guns of the prior art typically are fabricated so that the elongated barrel is an integral part of the gun; i.e., the barrel and trigger housing or handle are fabricated together in a single unit. This makes for a rather cumbersome tool, difficult to fit into a toolbox with other tools and prone to be bent or distorted from contact with other tools in the toolbox.

The invention features a caulking gun that is provided with a thumb activatable cam lever that engages or disengages a dog mechanism so that a dripless condition or a standard operation condition can be selected. Further, an extra long clean out rod is provided on the handle top. The grip is ergonomically shaped having an integral soft overmolded cushion to prevent operator fatigue. The invention also features a detachable barrel which can be readily removed from the handle at the end of the job and stowed in a toolbox or other carrying device. The barrel can also be easily and quickly reassembled when needed for use.

In brief particular arrangements of the present invention include two main parts which can be easily secured together or taken apart. When assembled, the connection between the long barrel portion and the handgrip portion is firmly and rigidly established. Yet the structural configuration of the connection joint is such that the two components can be easily and quickly separated from each other, and just as easily and quickly joined together again. To that end, each of the two components is provided with a flat planar surface at the end facing the other component. Thus, the forward end of the handgrip portion comprises a round flat base. Projecting from the forward face of this base is a round flat disk joined to the base by a portion of reduced diameter relative to the fiat disk. The disk and the base are spatially separated by the reduced diameter portion. This configuration establishes a circumferential slot which defines a circumferential lip around the disk.

The rearward end of the caulking gun barrel is shaped in a configuration which mates with the forward end of the handgrip portion. To this end, the rearward portion of the barrel is shaped with a circumferential inwardly projecting lip extending approximately 180° about the center opening in a U-shaped configuration. This U-shaped lip engages the outwardly projecting lip of the handgrip portion by receiving the flat round disk in an interlocking configuration until the two components are fully engaged. The lip on the barrel slides over the lip on the handgrip portion and is locked in place with the insertion of the push rod. This makes for easy assembly without requiring additional hardware and allows the barrel to be rotated relative to the handgrip portion. The friction feel of the rotation is accomplished by using different material hardness for the handgrip portion and the barrel. For example, in one preferred embodiment, the lip and flat attachment member of the handgrip portion is fabricated of fiber reinforced nylon, whereas the lip and adjacent surface of the barrel portion is made of polypropylene or polyethylene. Assembly of the gun is completed by placing a pusher plate on the forward end of the push rod end securing it in place with a nut threaded onto the end of the push rod. The caulking gun may then be operated in a conventional manner, with repetitive squeezes of the trigger mechanism ratcheting the push rod forward to cause material to be extruded from the caulk tube. This construction advantageously permits the barrel and caulk tube to be rotated as desired, relative to the handgrip portion, for better placement of the nozzle when extruding caulking material.

The handgrip portion itself is formed with a number of features which constitute improvements over prior art caulking guns. A thumb operable lever is positioned on the top side of the handle so that a drip/no drip position can be easily selected. Positioned entirely within the handle top portion at the rear is a compression spring loaded silicon washer which enables the no drip operation. In the middle section of the handle interior is a cam actuator which is operates a thumb releasable dog switch which serves to provide the drip/no drip conditions. A leaf spring is used to urge the dog against the cam actuator. By using the leaf spring, the mechanism is able to be fitted into a smaller compartment that would be experienced if a compression type of spring had been utilized. The top of the handgrip portion is provided with a narrow, pivoted rod for piercing the nozzle of a caulk tube. The rod is adapted to be moved to a position in line with the adjacent handgrip portion. A retainer element projecting from the handgrip portion is provided to stow the rod. Rearward of that is an L-shaped projecting guard member which receives the rod when stowed and protects the user's hand from being pierced by the rod.

The handgrip itself is coated, at least in part, with a cushioning layer to ease the stress on the user's hand from repetitive squeezing of the trigger of the handgrip. This cushioning layer may be of any resilient material such as foam or sponge rubber, foam polyurethane, or the like. Near the top of this cushioning layer is a molded projection of generally U-shape which extends around the back of the handgrip. This helps the handgrip to seat in the user's hand by stopping the hand as it is moved upward along the handgrip to a working position.

The trigger member is shaped with three finger-receiving portions extending downwardly from the upper end of the trigger. The first two are shaped to fit the first and second fingers of the average user; the third one which is near the tip of the trigger is shaped to accommodate two fingers, the third and fourth fingers on the hand of the user. This provides a substantially more comfortable handgrip, better accommodated to the user's hand.

BRIEF DESCRIPTION OF THE DRAWINGS

A better understanding of the present invention may be realized from a consideration of the following detailed description, taken in conjunction with the accompanying drawings, in which.

DETAILED DESCRIPTION OF THE PREFERRED EMBODIMENT

Figure 1:
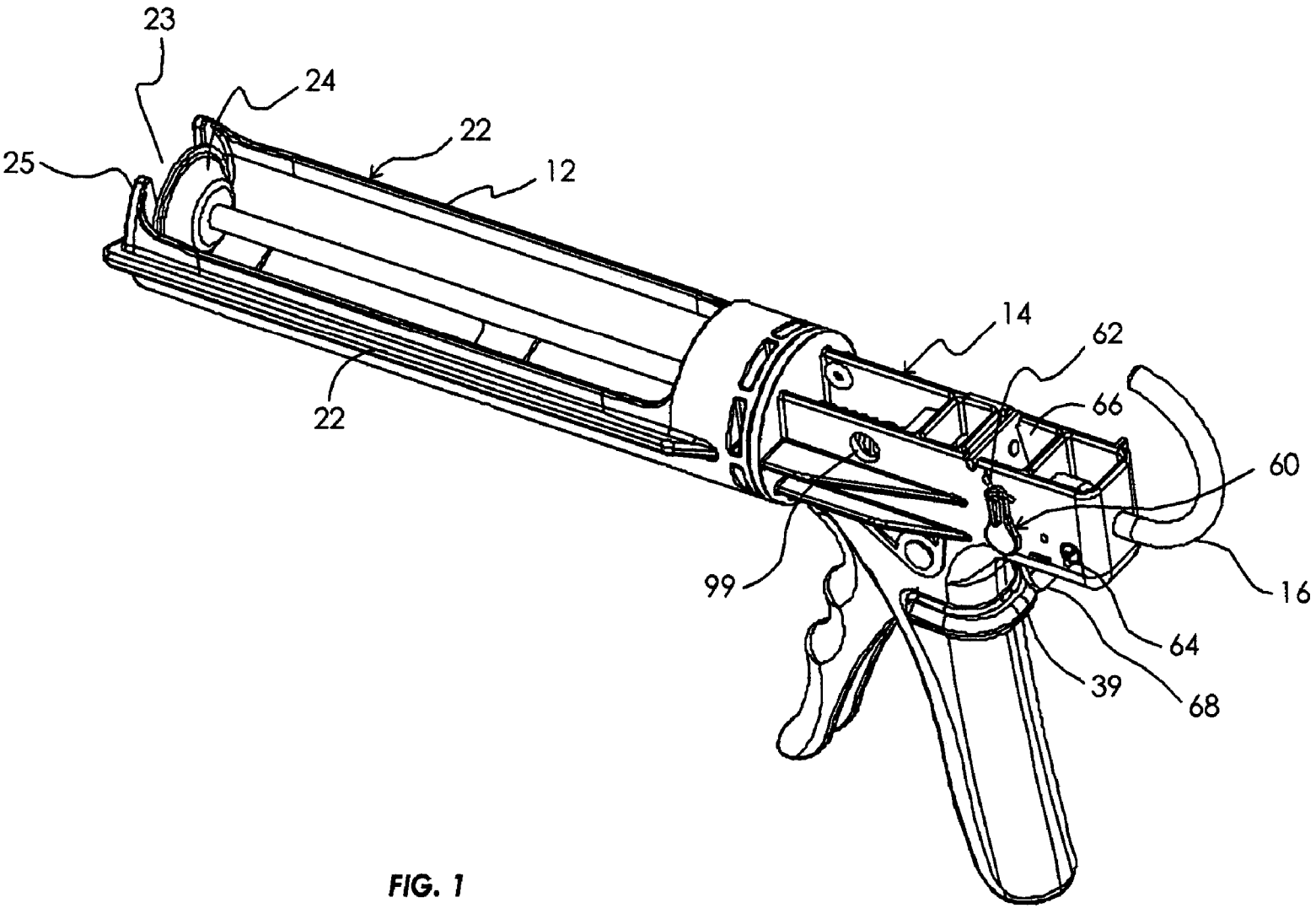
FIG. 1 is a schematic perspective review, taken from the left rear quarter, of one particular arrangement of a caulking gun in accordance with the present invention.

As shown in the drawings and with particular reference to FIG. 1, a preferred embodiment 10 is shown comprising a barrel-shaped tube housing 12 and a handgrip portion or trigger housing 14. The barrel-shaped tube housing 12 is cut away along the side walls 22 to provide easy access for inserting a caulk tube into the tube housing. The elements 22 are reinforcing ribs which are mounted lengthwise along the outside of the tube housing 12 to add stiffness and support for the tube housing, particularly for the edge portions of the half-cylinder. Another pair of reinforcing ribs below the elements designated 22 provide reinforcement for the tube housing at the location of the lower central cutout shown in FIG. 7.

Figure 7:
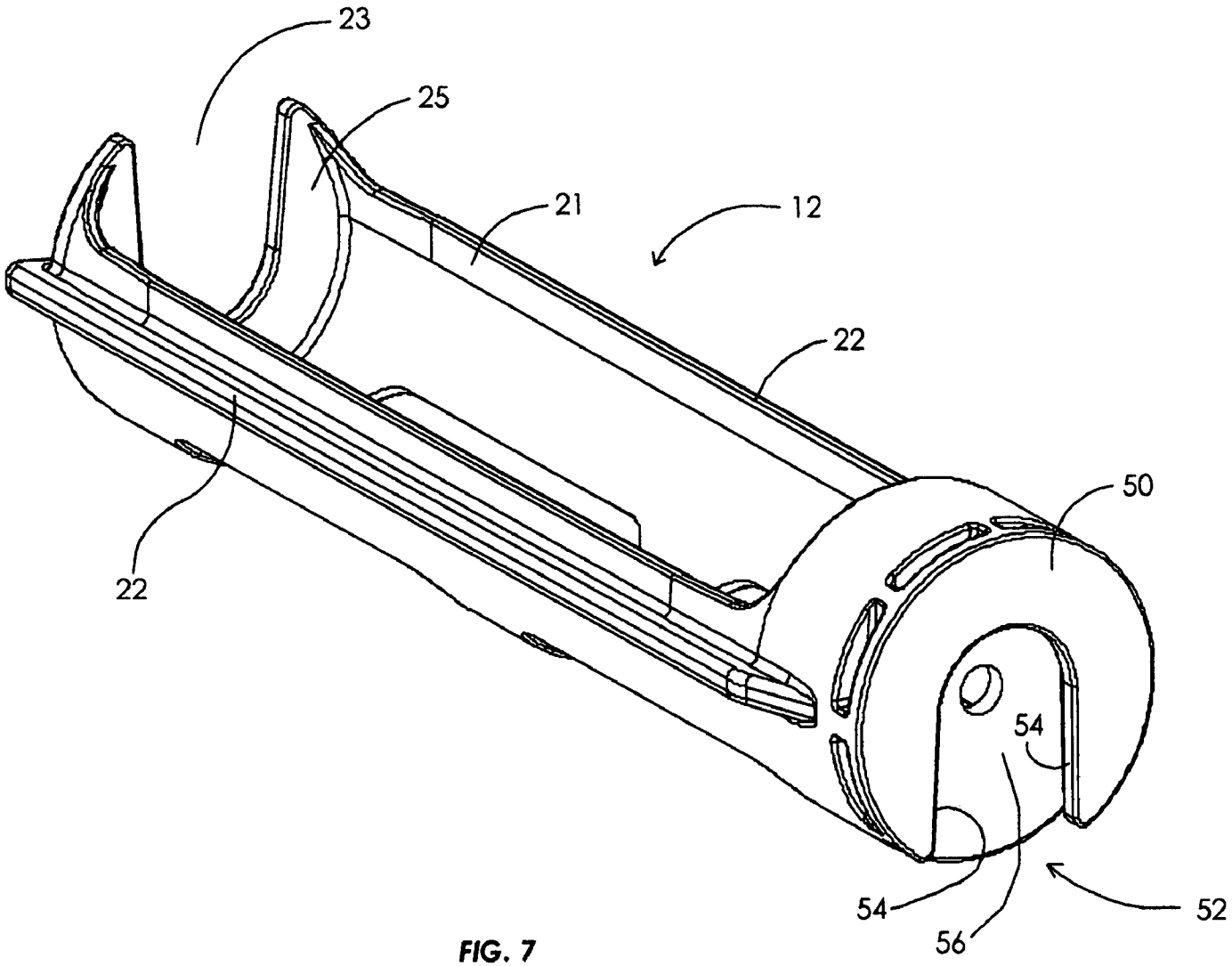
FIG. 7 is a perspective view of the barrel portion of the caulking gun of FIG. 1, disassembled from the handgrip portion.

Also shown in FIG. 7 (as well as in FIG. 2) are a pair of triangular sections 27 which are placed at the forward end of the tube housing 12 to provide reinforcement for the forward wall 25 where it attaches to the tube housing.

Passing through these two housings is a piston rod 16. Although the piston rod 16 is shown as installed in the trigger housing 14, it can be withdrawn out the rearward end of the housing 14 for complete removal. With the piston rod removed, the two portions can be easily disassembled. When the caulk gun is completely assembled, the piston rod 16 passes through central holes 20A and 20B in the barrel-shaped tube portion and the handgrip portion, respectively. Also shown in FIG. 2, push plate 24 and a retaining nut 26 for mounting on the threaded forward end 28 of the piston rod 16.

Figure 11:
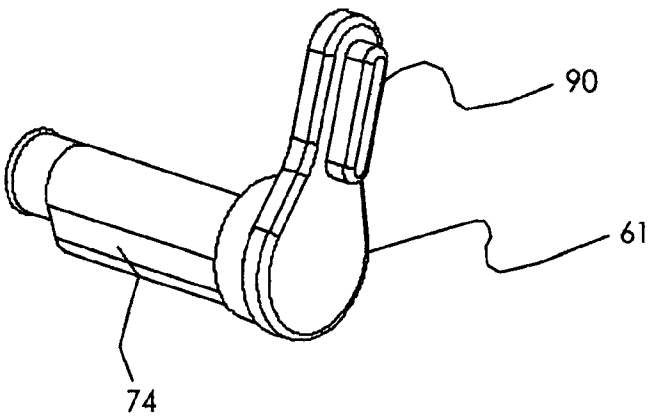
FIG. 11 is a perspective view of the cam lever assembly.

Positioned within the seamless box design trigger housing 14 in middle section 66 is the drip/no drip selection mechanism 60 which is described in detail below. Lever arm 90 (shown in FIG. 11) enables mechanism 60 to be moved to drip position 62 or to no drip position 64 as indicated by the indicia provided on trigger housing 14. Thumb release portion 68 which extends downwardly from trigger housing 14 enables an operator to easily release rod 16 so that it can be withdrawn rearward.

Figure 2:
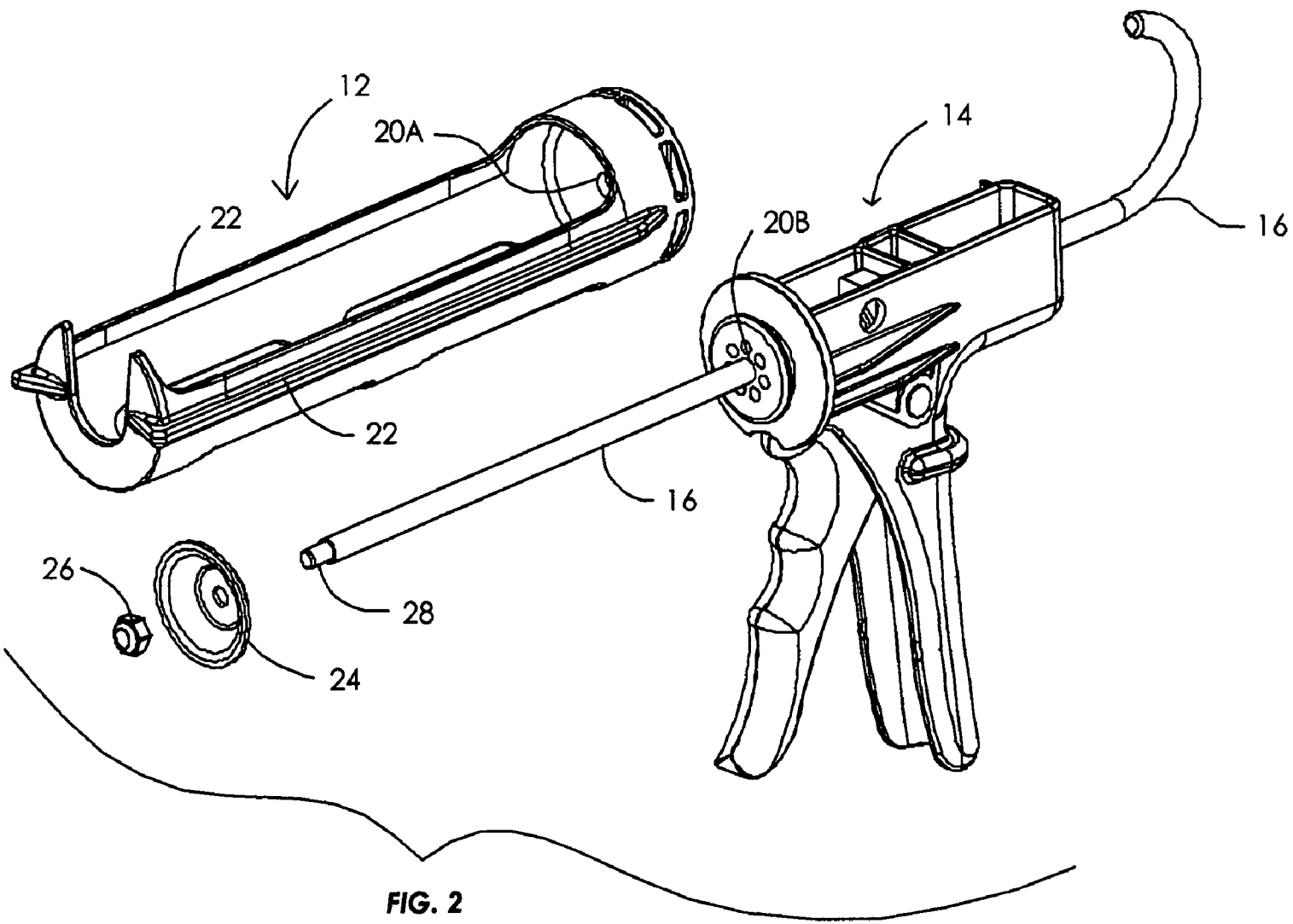
FIG. 2 is an exploded view of the caulking gun of FIG. 1 showing only the takedown barrel feature.
Figure 3:
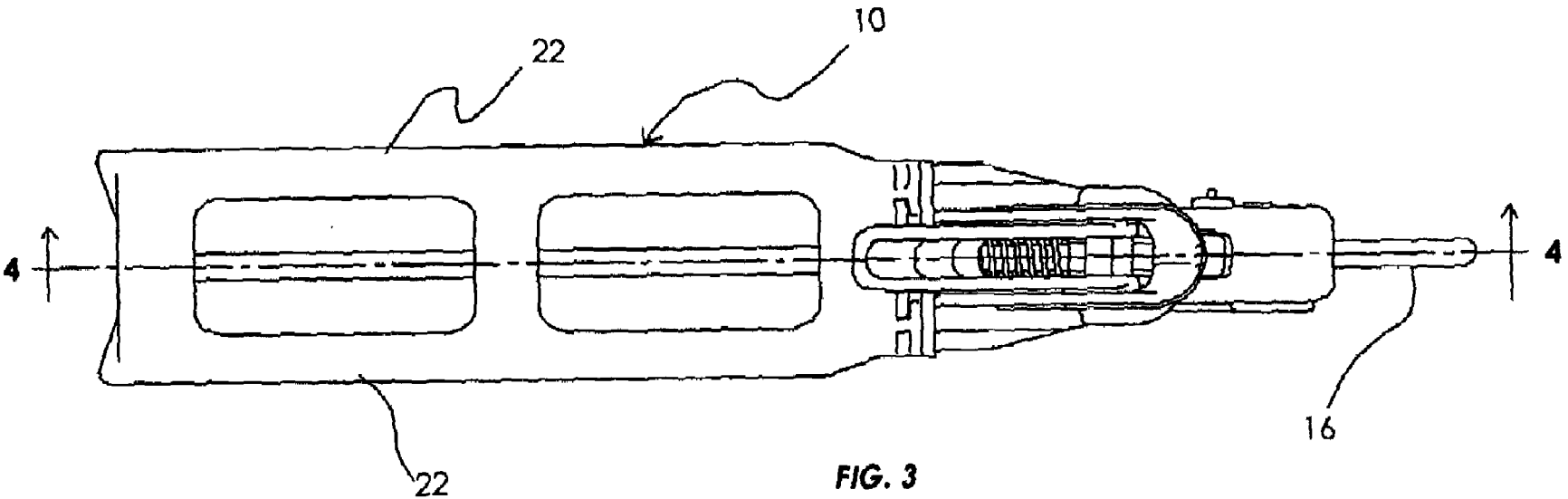
FIG. 3 is a schematic top view of the caulking gun of FIG. 1.
Figure 5:
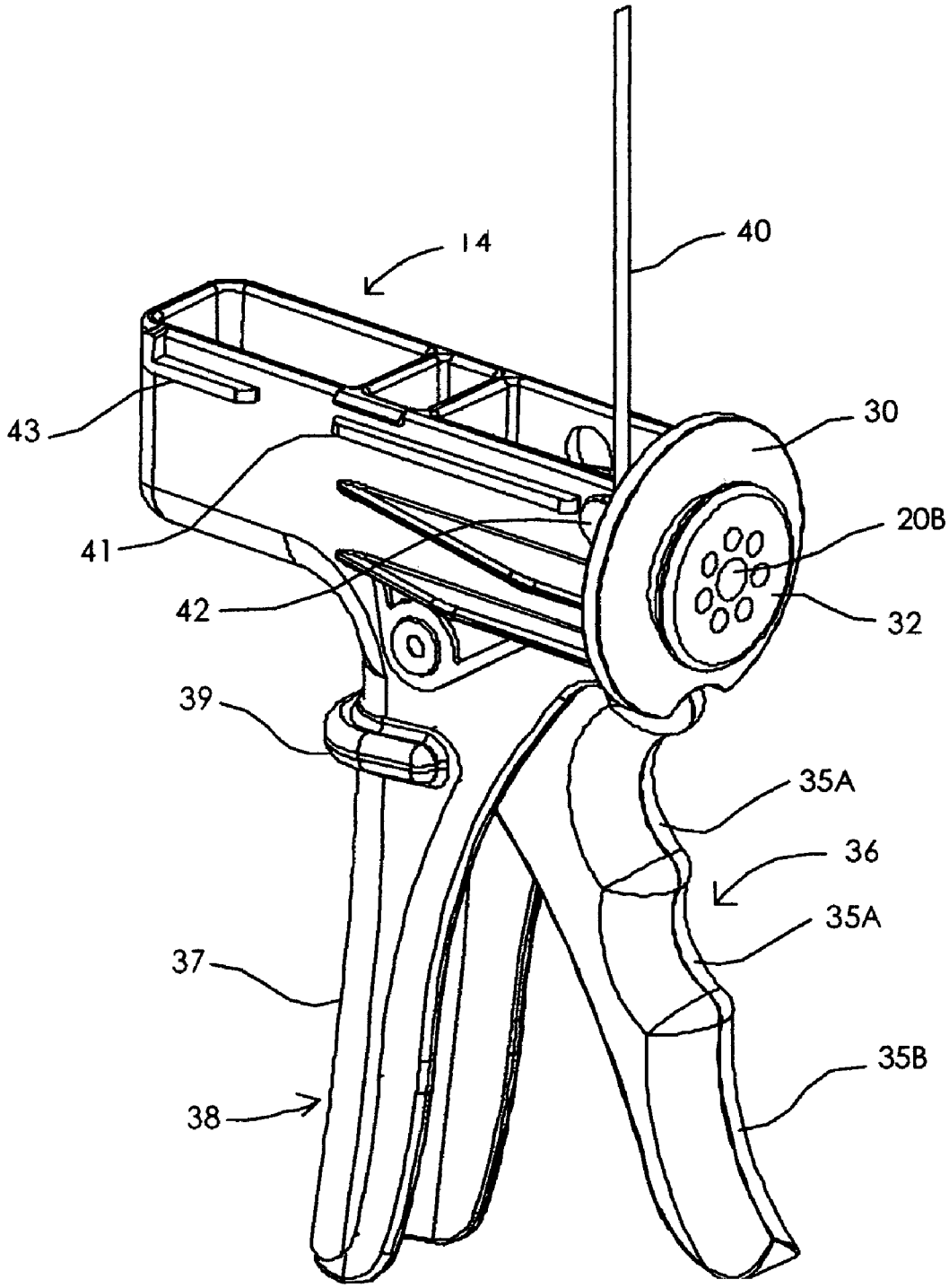
FIG. 5 is a perspective view of the handgrip portion of the caulking gun of FIG. 1 showing the rod 40 in position for use.
Figure 6:
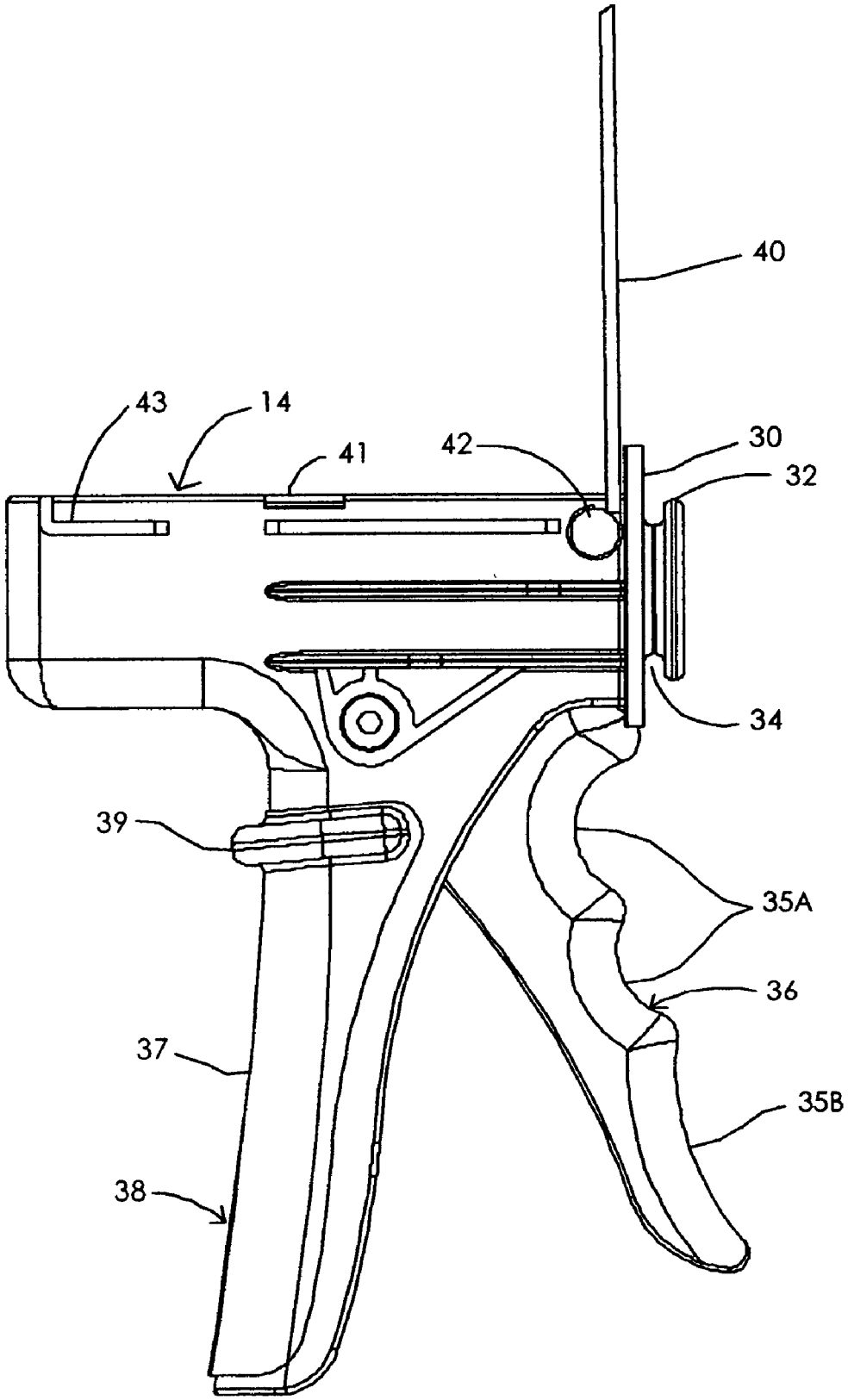
FIG. 6 is a side elevational view of the handgrip portion of FIG. 5, taken from the right-hand side thereof.

FIGS. 2, 5 and 6 are views of the handgrip portion 14 with the dripless/no drip mechanism 60 removed for clarity. Both show the round flat base surface 30 and the attached lip 32 displaced by a circumferential slot 34. Also shown is a trigger 36 pivotably mounted in the handgrip housing 14 and forming, with the downwardly extending portion 38, a handgrip for the housing 14. A thin rod 40 is shown extending vertically from the mounting member 42. The rod 40 is provided for puncturing the nozzle of a caulk tube or for cleaning the opening in the caulk tube once it has been punctured. Rod 40 is stowed by rotation about the pivot member 42 to a retainer member 41 extending along the side of the housing 14.

Near the rearward end of the housing 14 is an L-shaped projection 43 into which the end of the rod 40 fits when it is stowed into the retainer member 41. The projection 43 is a guard which protects a user's hand from being jabbed by the end of the rod 40 as the caulking gun is used.

Also shown in FIGS. 5 and 6 is a cushioning layer 37 along the back of the downwardly extending portion 38. This layer 37 is affixed to portion 38 as, for example, by fusing in the molding process and it has an outwardly projecting U-shaped stop portion 39. Both the layer 37 and projection 39 are molded together, and extend around the back and along both sides of the portion 38. The projecting U-shaped member 39 helps to locate the caulk gun in the hand of a user, since the gripping portion of the hand rides directly up to the U-shaped projection 39.

Along the length of the trigger 36 are a series of finger grooves 35A and 35B. These are shaped to fit the user's fingers; the two upper grooves 35A are shaped to receive the first and second fingers of the user's hand. The lowest indentation 35B is longer in order that it will accommodate the third and fourth fingers of the user's hand. This configuration provides for a very comfortable, natural gripping tool which, by virtue of its shape, enables the user to hold the handgrip portion in his hand, with less likelihood that the handgrip will slip from its natural position.

Figure 8:
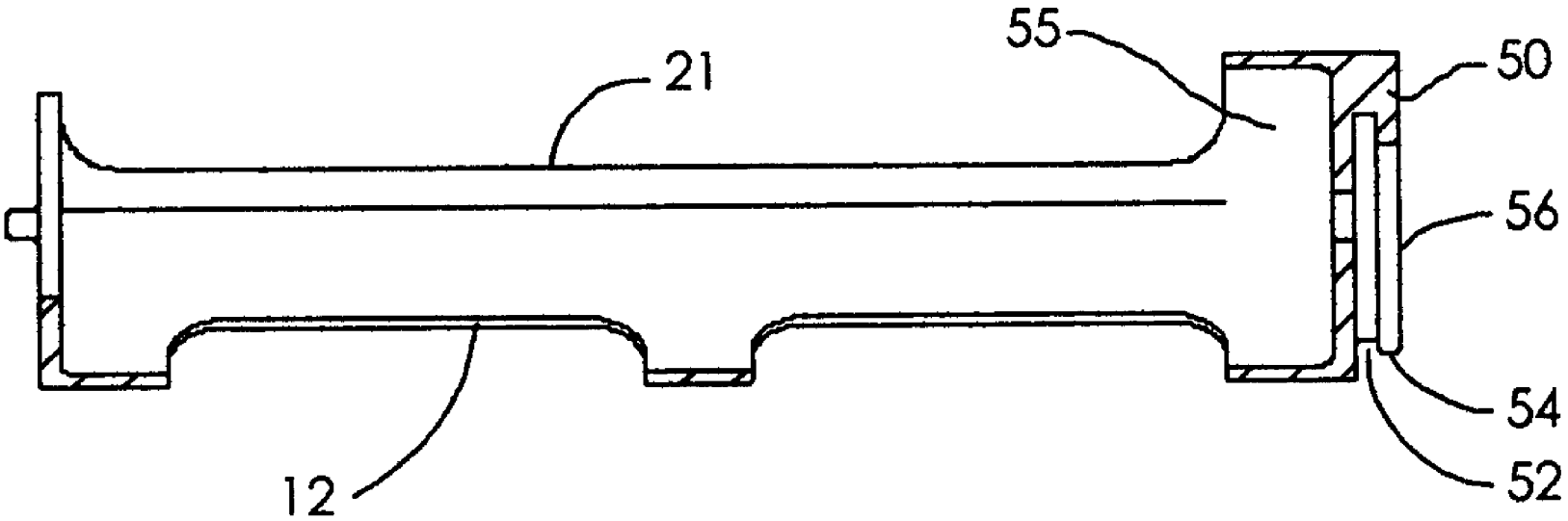
FIG. 8 is a schematic elevational view of the barrel portion of FIG. 7, taken from the left-hand side thereof.
Figure 10:
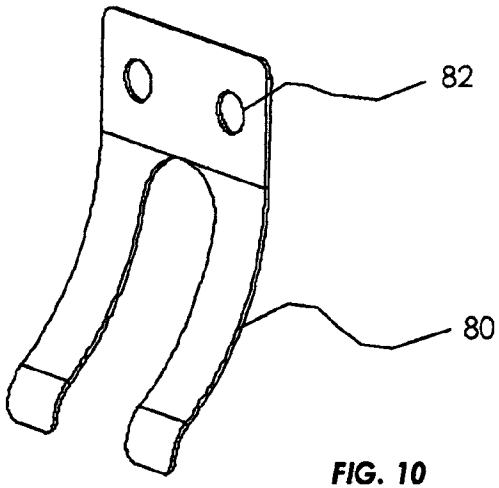
FIG. 10 is a perspective view of the leaf spring.
Figure 9:
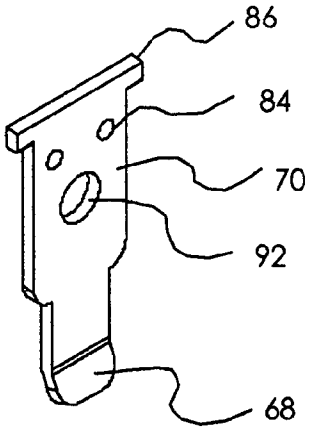
FIG. 9 is a perspective view of the drip switch dog.

FIGS. 7 and 8 are views of the barrel. A U-shaped opening 23 in the forward wall 25 of the barrel 12 is provided to permit the nozzle of the caulk tube to extend forward from the barrel. The rearward end of the barrel 12 is formed with a planar face 50 which has an inner cavity 52 having radially inwardly projecting edges 54 formed in an inverted U-shape defining an inner lip suitable for engaging the outwardly extending lip 32 of the handgrip portion 14. The edges 54 form a circular groove extending halfway around the central opening 20A.

Figure 4A:
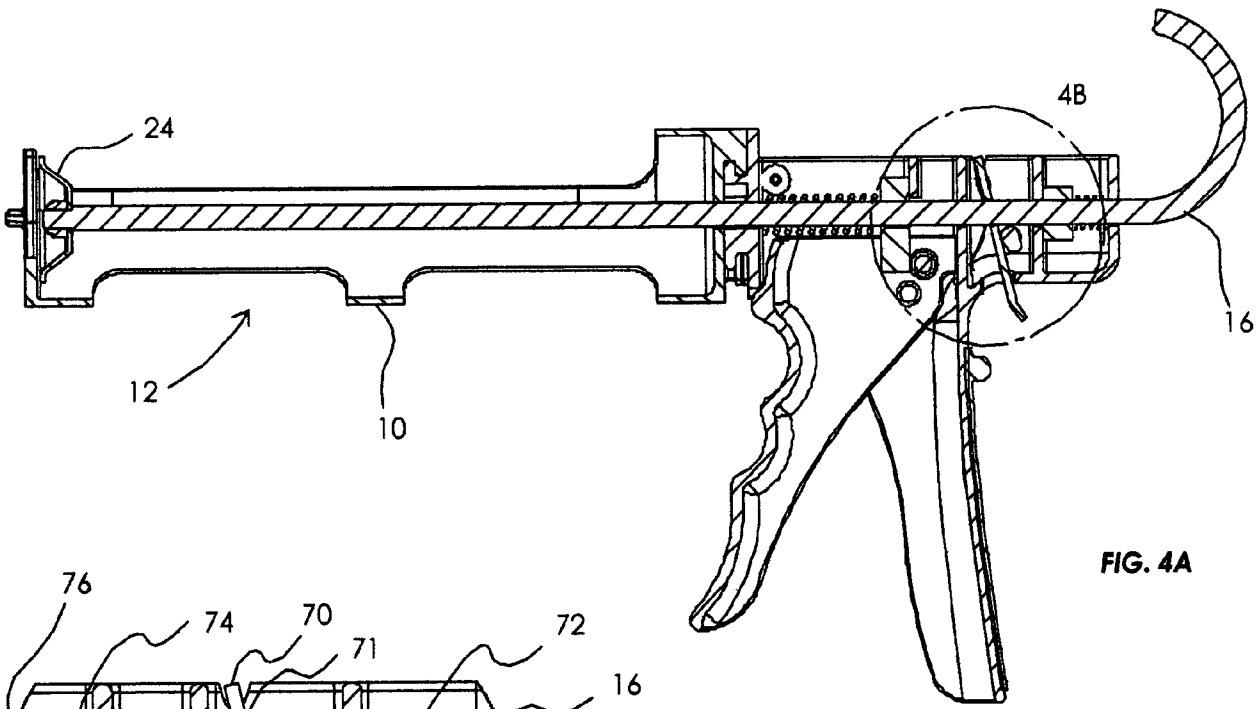
FIG. 4A is a side sectional view of the caulking gun of FIG. 1, taken along the line 4—4 of FIG. 3.

FIG. 8 is an enlarged view of the barrel portion 12 as depicted in FIG. 4. The edges 54 of the cavity 52 are displaced from the inner termination of the cavity 52 by a semi-circular slot separating the edges 54 from the forward surface 56 and form an inwardly directed lip positioned to engage the lip 32.

The barrel 12 is shaped to form a central trough 21 to hold a caulk tube. The barrel 12 is open above the trough 21 to permit the ready insertion of the caulk tube. When in place, the caulk tube projects into the recess 55 at the rear of the barrel 12.

The barrel 12 of the present invention constitutes a significant improvement over the prior art by the formation of two mating parts of the gun which are capable of ready assembly or disassembly when setting up for use or for storage in a toolbox. The connecting members between the two parts of the caulking gun have a particular configuration which establishes a strong, rigid connection as needed for the support of the caulk tube when in use.

Barrel 12 can be configured as sized to hold standard caulking tubes or the larger one quart size by merely adjusting the dimensions of the barrel cage 12 accordingly.

Referring now to FIGS. 4A, 4B, 9, 10, 11, the dripless/no drip mechanism 60 of invention 10 is shown. The dripless mechanism functions similarly to that disclosed in U.S. Pat. No. 5,887,765, incorporated herein by reference. Drive dog 74 which is biased by compression spring 76 causes rod 16 to advance when the trigger 36 is pulled, thus causing caulk (not shown) to be extruded. Silicon washer grip 72 provides a forward biasing for rod 16. This mechanism, by action of gripping force of grip 72 and resilient force of spring 78 biases rod 16 in the forward direction, preventing rod 16 from moving back more than is required to relieve the pressure in the caulk tube when trigger 36 is released. The friction grip can be overcome by pulling rod 16 rearward so that a new tube of caulking material can be inserted.

Figure 4B:
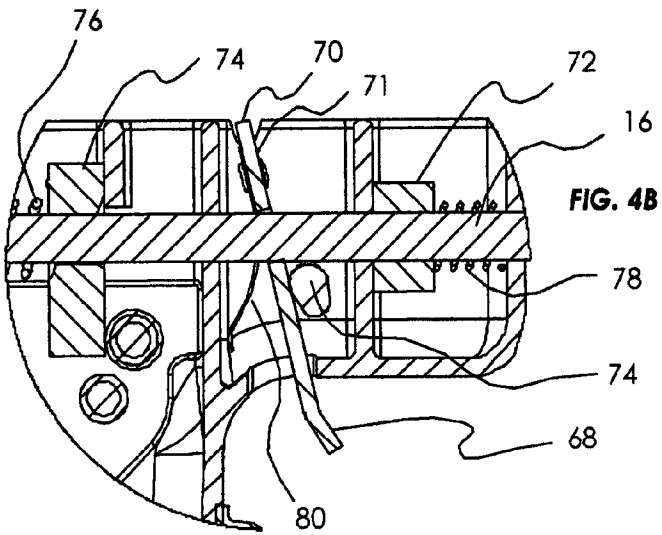
FIG. 4B is an enlarged view of the section identified in FIG. 4A.

The no drip mechanism has three major components: cam lever actuator 61, drip switch dog 70 and leaf spring 80. When cam lever actuator 61 is turned toward no drip position 64, invention 10 operates as explained above. However, when cam lever actuator 61 is moved toward drip position 62, the "drip feature" is provided. Leaf spring 80 is urged against drip switch dog 70. Rod 16 passes through opening 92 which has sharp edges. Preferably dog 70 has a bright zinc coat finish. When in the no drip position, cam 74 causes dog 70 to be substantially perpendicular to rod 16 so that rod 16 can pass through hole 92 unobstructed. When in the drip position, cam 74 is as shown in FIG. 4B such that the edge of opening 92 engages rod 16 and prevents rod 16 from moving backward thus keeping in the caulk tube even when trigger 36 is released. To release cam 74, an operator merely pushes on thumb release 68 of dog 70. Dog 70 is fitted into slots 71 and biased with leaf spring 80 via rivets through openings 84 in dog 70 and openings 82 in leaf spring 80. As shown, the entire drip/no drip mechanism 60 is housed within middle section 66. The use of leaf spring 80 rather than a compression spring such as spring 78 and 76 reduces the amount of space required to house this structure.

Figure 12:
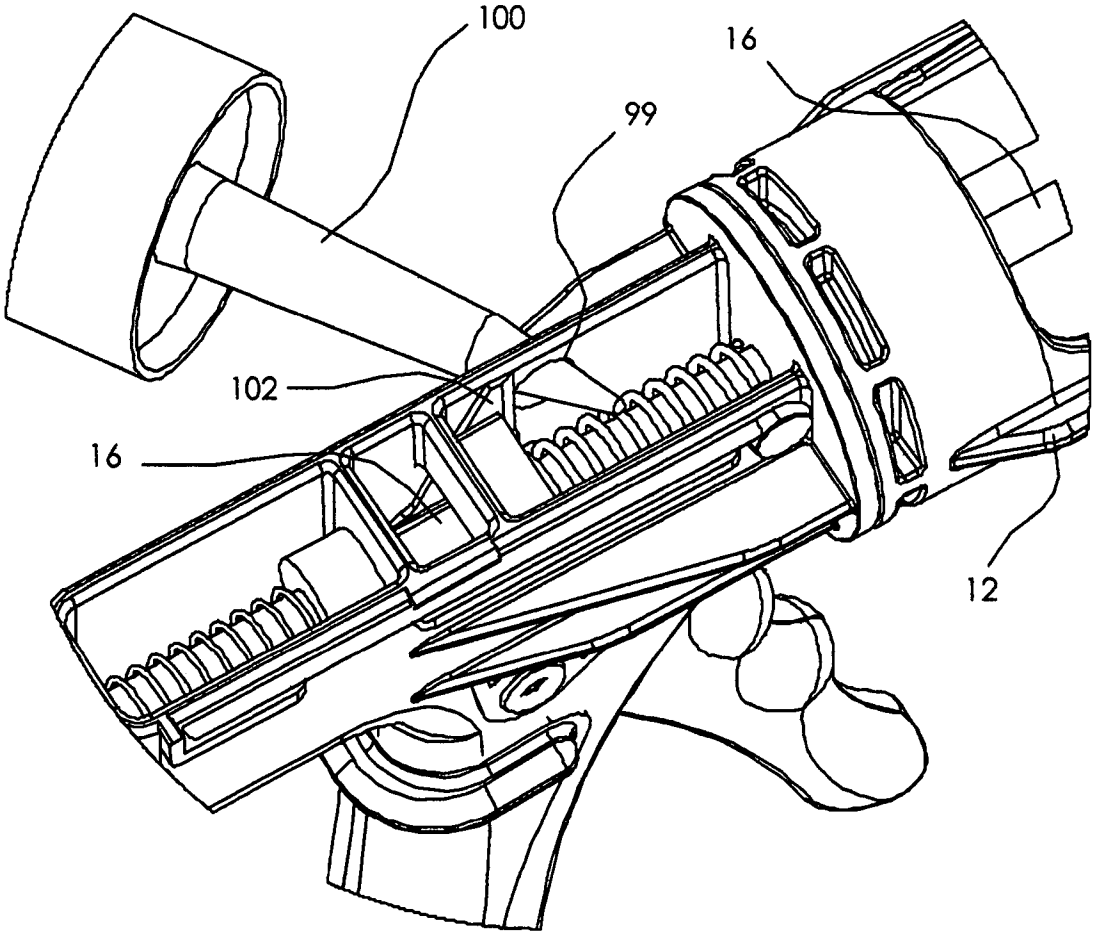
FIG. 12 is a top view of the precision cutter.

As shown in FIG. 12, precision cutter 102 is provided to cut off the tip 100 of a caulking tube (not shown). Cutter 102 is attached to trigger assembly 36 so that pulling the trigger causes cutter 102 to slide forward, thus cutting off the tip 100 that has been inserted through opening 99 in the trigger housing 14.

While certain representative embodiments of the invention have been described herein for the purposes of illustration, it will be apparent to those skilled in the art that modification therein may be made without departure from the spirit and scope of the invention.

What is claimed is:

1. A caulking gun for dispensing caulking material enclosed within a tube having a nozzle, said caulking gun comprising:

a rotatable barrel cage for holding the caulking tube wherein said rotatable barrel cage has an inner inverted U-shaped lip;

a trigger housing releasably attached to said barrel cage wherein said trigger housing has a circumferential outwardly extending lip for engaging said U-shaped lip of said rotatable barrel cage;

a trigger assembly pivotably attached to said trigger housing;

a pistol rod extending longitudinally positioned within said barrel cage and attached said trigger housing;

a push plate releasably attached to said piston rod that is used to extrude caulking material out of said tube by having said push plate move within the tube of caulk when said trigger assembly is squeezed and wherein when said plush plate is removed from said piston rod, said barrel cage can be disengaged from said trigger housing and said caulking gun thereby is more easily stowable than when said carrel cage is attached to said trigger housing.

2. The caulking gun of claim 1 wherein said trigger housing further comprises precision cutter means, attached to said trigger assembly, for cutting the tip off of said caulking tube when said trigger assembly is squeezed.

3. The caulking gun of claim 1 wherein said trigger housing further comprises a pivotable rod attached to said trigger housing that is useful for piercing the nozzle of the caulk tube and wherein said rod is stowed in L-shaped projecting guard member to protect against injury when said rod is not in use.

4. The caulking gun of claim 1 wherein said trigger housing further comprises a handgrip that is at least partially covered with a cushioning layer to ease the stress on an operator's hand when repetitively squeezing said trigger assembly.

5. The caulking gun of claim 1 wherein said trigger assembly having an upper end and further comprising a finger-receiving portion having three indentations extending downwardly from the upper end and wherein the first indentation is used to support the index finger of an operator's hand, the second indentation is used to support the middle finger of the operator's hand, and the bottommost indentation is used to support the ring finger and little finger of the operator's hand.

6. A caulking gun for dispensing caulking material enclosed within a tube having a nozzle, said caulking gun comprising:

a barrel cage for holding the caulking tube wherein said rotatable barrel cage has an inner inverted U-shaped lip;

a trigger housing attached to said barrel cage wherein said trigger housing has a circumferential outwardly extending lip for engaging said U-shaped lip of said rotatable barrel cage;

a trigger assembly pivotably attached to said housing;

a piston rod extending longitudinally positioned within said barrel care and attached said trigger housing;

a push plate attached to said piston rod;

drive means, connected to said trigger assembly, for extruding caulking material out of said tube by having said push plate move within the tube of caulk when said trigger assembly is squeezed;

forward biasing means for preventing piston rod from moving back more than is required to relieve the pressure in the caulk tube when said trigger assembly is released, thus providing "no drip" operation;

dog means for preventing piston rod from moving back when trigger assembly said is released, thus providing "drip" operation;

actuator means for selecting between "no drip" operation and "drip" operation wherein said actuator means disengages dog means.

7. The caulking gun of claim 6 wherein said trigger housing further comprises precision cutter means, attached to said trigger assembly, for cutting the tip off of said caulking tube when said trigger assembly is squeezed.

8. The caulking gun of claim 6 wherein said trigger housing further comprises a pivotable rod attached to said trigger housing that is useful for piercing the nozzle of the caulk tube and wherein said rod is stowed in L-shaped projecting guard member to protect against injury when said rod is not in use.

9. The caulking gun of claim 6 wherein said trigger housing further comprises a handgrip that is at least partially covered with a cushioning layer to ease the stress on an operator's hand when repetitively squeezing said trigger assembly.

10. The caulking gun of claim 6 wherein said trigger assembly having an upper end and further comprising a finger-receiving portion having three indentations extending downwardly from the upper end and wherein the first indentation is used to support the index finger of an operator's hand, the second indentation is used to support the middle finger of the operator's hand, and the bottommost indentation is used to support the ring finger and little finger of the operator's hand.

11. A caulking gun for dispensing caulking material enclosed within a tube having a nozzle, said caulking gun comprising:

a rotatable barrel cage for holding the caulking tube wherein said rotatable barrel cage has an inner inverted U-shaped lip;

a trigger housing releasably attached to said barrel cage wherein said trigger housing has a circumferential outwardly extending lip for engaging said U-shaped lip of said rotatable barrel cage;

a trigger assembly pivotably attached to said trigger housing;

a piston rod extending longitudinally positioned within said barrel care and attached said trigger housing;

a push plate releasably attached to said piston rod such that when said plush plate is removed from said piston rod, said barrel cage can be disengaged from said trigger housing and said caulking gun thereby is more easily stowable than when said carrel cage is attached to said trigger housing;

drive means, connected to said trigger assembly, for extruding caulking material out of said tube by having said push plate move within the tube of caulk when said trigger assembly is squeezed;

forward biasing means for preventing piston rod from moving back more than is required to relieve the pressure in the caulk tube when said trigger assembly is released, thus providing "no drip" operation;

dog means for preventing piston rod from moving back when said trigger assembly is released, thus providing "drip" operation;

actuator means for selecting between "no drip" operation and "drip" operation wherein said actuator means disengages dog means.

12. The caulking gun of claim 11 wherein said trigger housing further comprises precision cutter means, attached to said trigger assembly, for cutting the tip off of said caulking tube when said trigger assembly is squeezed.

13. The caulking gun of claim 11 wherein said trigger housing further comprises a pivotable rod attached to said trigger housing that is useful for piercing the nozzle of the caulk tube and wherein said rod is stowed in L-shaped projecting guard member to protect against injury when said rod is not in use.

14. The caulking gun of claim 11 wherein said trigger housing further comprises a handgrip that is at least partially covered with a cushioning layer to ease the stress on an operator's band when repetitively squeezing said trigger assembly.

15. The caulking gun of claim 11 wherein said trigger assembly having an upper end and further comprising a finger-receiving portion having three indentations extending downwardly from the upper end and wherein the first indentation is used to support the index finger of an operator's hand, the second indentation is used to support the middle finger of the operator's hand and the bottommost indentation is used to support the ring finger and little finger of the operator's hand.

* * * * *